US011517937B1

(12) United States Patent
Johansson

(10) Patent No.: US 11,517,937 B1
(45) Date of Patent: Dec. 6, 2022

(54) METHOD OF PAINTING FLOWERS WITH MODIFIED MAKEUP BRUSH OR ALTERNATIVE SPECIALLY CONFIGURED BRUSH

(71) Applicant: David Johansson, Seattle, WA (US)

(72) Inventor: David Johansson, Seattle, WA (US)

( * ) Notice: Subject to any disclaimer, the term of this patent is extended or adjusted under 35 U.S.C. 154(b) by 5 days.

(21) Appl. No.: 17/391,730

(22) Filed: Aug. 2, 2021

(51) Int. Cl.

| | |
|---|---|
| ***A46B 9/02*** | (2006.01) |
| ***B05D 1/28*** | (2006.01) |
| ***B05D 5/00*** | (2006.01) |
| ***A46D 1/04*** | (2006.01) |

(52) U.S. Cl.
CPC ..... *B05D 1/28* (2013.01); *A46B 9/021* (2013.01); *A46D 1/04* (2013.01); *B05D 5/00* (2013.01); *A46B 2200/1046* (2013.01)

(58) Field of Classification Search
CPC ... B05D 1/28; A46B 9/021; A46B 2200/1046; A46D 1/04
See application file for complete search history.

(56) References Cited

U.S. PATENT DOCUMENTS

| | | | | |
|---|---|---|---|---|
| 9,642,441 | B1 * | 5/2017 | Ajootian | A45D 40/28 |
| 9,675,167 | B2 * | 6/2017 | Xavier | A46B 9/028 |
| 2018/0153293 | A1 * | 6/2018 | Dovellos | A46B 9/021 |
| 2019/0133310 | A1 * | 5/2019 | Beard | A46B 11/063 |

* cited by examiner

*Primary Examiner* — Nathan T Leong
(74) *Attorney, Agent, or Firm* — The Concept Law Group, P.A.; Robert C. Kain

(57) ABSTRACT

The method of painting flowers with a makeup brush or a specially made brush utilizes a brush with a plurality of attached bristles (conical or cylindrical) forming peripheral arcuate bristle segments. Bristle segments are cut/trimmed to form arcuate voids forming bristle fence slats (spaced apart). Central bristles are trimmed/cut to form a central void in the bristle head, forming a bristle fence about the void. The slats, loaded with petal flower color paint, are placed gently at a nascent flower location on a substrate. Sometimes prior, a dollop of ovary flower color is placed at the nascent center flower location before the loaded bristle fence slats are pressed about the ovary flower center. The special brush with the central void and the bristle fence slats may be made by the painter or manufactured.

8 Claims, 11 Drawing Sheets

METHOD OF PAINTING FLOWERS WITH MODIFIED MAKEUP BRUSH OR ALTERNATIVE SPECIALLY CONFIGURED BRUSH

FIELD OF THE INVENTION

The present invention relates to a method of painting flowers with a modified makeup brush or, in the alternative, a specially configured brush having a plurality of spaced apart bristle fence slats.

BACKGROUND OF THE INVENTION

In painting or decorating, the painter may dedicate significant time and effort in painting a flower on a canvas, paintable paper, metal, wall, ceiling, surface or other type of substrate (collectively herein a "substrate"). The present invention utilizes a specially configured or trimmed brush, preferably a makeup brush, to assist the painter in artistically creating a flower image on the substrate.

OBJECT OF THE INVENTION

It is an object of the present invention to provide a user or painter with a better tool and an improved method to paint flowers.

SUMMARY OF THE INVENTION

With the foregoing and other objects in view, there is provided, in accordance with the invention, a method of painting flowers with a makeup brush utilizes a makeup application brush having a handle and a plurality of attached bristles extending no more than 3 inches from the handle. The attached bristles extend from the handle in a solid cylindrical shape or a conical shape. If a conical-shaped brush is used, the conical outboard radius should not exceed twice the attached bristle extension (the bristle extension from the handle is no more than 3 inches).

A plurality of peripheral arcuate bristle segments are cut or trimmed away from the plurality of attached bristles to form no less than 4 arcuate bristle segment voids (voids created by cutting and trimming peripheral bristles segments) thereby forming remaining arcuate bristle segments which extend from the handle. These arcuate attached bristle segments form a bristle fence. A central plurality of bristles are trimmed or cut away to form a central void. This results in the remaining arcuate bristle segments forming a bristle fence about the central void. These arcuate bristle segments define spaced apart bristle fence slats about the central void of the bristle head.

To begin the painting process, the bristle fence slats are loaded with a petal flower color to form a loaded brush. A paintable substrate is provided. The loaded brush is placed at a nascent flower location on the substrate and the loaded brush is pressed gently on the substrate thereby spreading the bristle fence slats radially outward. Of course, when the paint-loaded bristle fence slats strike the substrate, paint is deposited on the substrate. The loaded brush is then lifted off the substrate.

In accordance with another feature, an embodiment of the present invention includes, prior to placing the loaded brush on the nascent flower location, a dollop of ovary flower color is placed at the nascent center flower location on the substrate to form and ovary flower center before placing the loaded brush at the nascent flower location on the substrate.

In this painting procedure, placing the loaded brush at the nascent flower location includes placing the loaded brush and the loaded bristle fence slats about the ovary flower center previously painted on the substrate. At the choice of the painter, the ovary flower color could be painted after the brush applies the petal flower color.

In accordance with a further feature of the present invention, another method of painting flowers with a brush utilizes a brush having a handle and a plurality of attached bristles extending no more than 2 inches from the handle. These bristles may either form a cylindrical shape or a conical shape. The bristles are cut or trimmed to form a plurality of spaced apart peripheral bristle fence slats about a central bristle void. The central bristle void is defined by a plurality of foreshortened attached bristles. The peripheral bristle fence slats define fence voids between adjacent peripheral bristle fence slats.

This method of painting includes loading the bristle fence slats with a petal flower color to form a loaded brush. A paintable substrate is provided. The loaded brush is placed at a nascent flower location on the substrate. The loaded brush is gently pressed on the substrate thereby spreading the bristle fence slats radially outward. The result is spreading the paint on the substrate to form petals of the flower. The loaded brush is then lifted off the substrate.

Although the invention is illustrated and described herein as embodied in a method of painting flowers with modified makeup brush or alternative specially configured brush, it is, nevertheless, not intended to be limited to the details shown because various modifications and structural changes may be made therein without departing from the spirit of the invention and within the scope and range of equivalents of the claims. For example, a makeup application brush could be used and specially cut by the painter. Thereafter, the painter could use the modified brush as discussed herein. Otherwise, a specially manufactured brush could be made with a central void and a plurality of bristle fence slats. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention. Further objects and advantages of the present invention are found in the detailed description of the preferred embodiment when taken in conjunction with the accompanying drawings.

DETAILED DESCRIPTION

Figure 1:
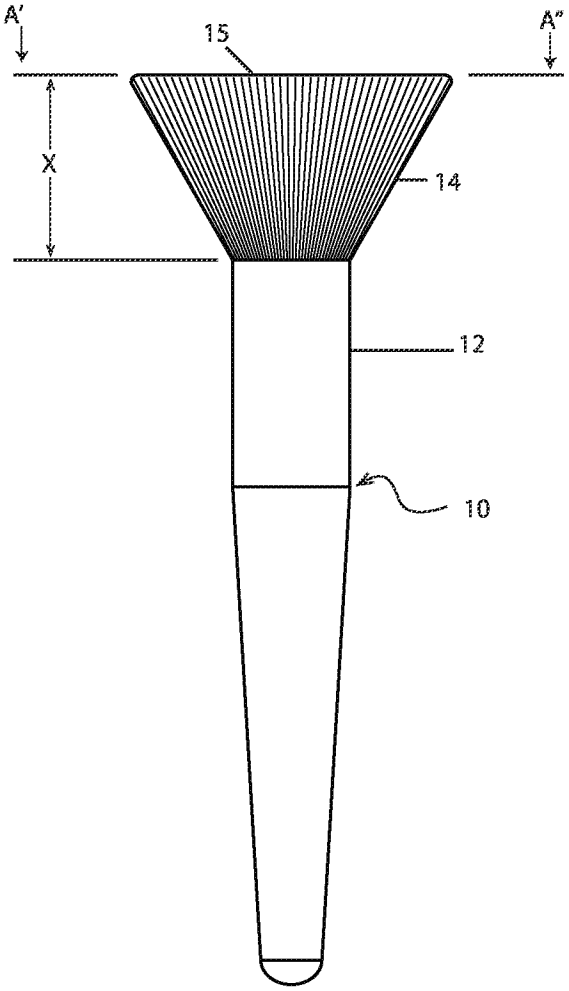
FIG. 1 diagrammatically illustrates a brush, preferably a makeup brush, having a conical bristle head.

The present invention relates to a method of painting flowers with a modified makeup brush or, in the alternative, a brush having a plurality of spaced apart bristle fence slats. While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 2:
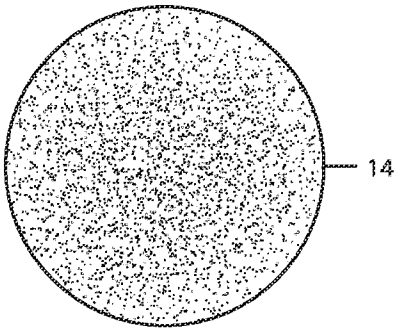
FIG. 2 diagrammatically illustrates a top view of the brush from the perspective of section line A'-A" in FIG. 1.

FIG. 1 diagrammatically illustrates a brush, preferably a makeup brush, having a conical bristle head. FIG. 2 diagrammatically illustrates a top view of the brush from the perspective of section line A'-A" FIG. 1. Both Figures are discussed concurrently herewith. The method of painting flowers utilizes a makeup application brush 10 (or a specially made brush similar to a makeup brush) having a handle 12 and a plurality of attached bristles formed as a brush head 14 extending no more than 3 inches from the handle (vertical distance X or height in FIG. 1). The attached bristles 14 which form the bristle brush head extend from the handle in a solid cylindrical shape (FIG. 3) or a conical shape (FIG. 1). If a conical-shaped brush is used, the conical outboard radius (the largest diameter span of bristle brush head 14 in FIG. 2) should not exceed twice the vertical bristle extension X (the bristle extension from the handle is no more than 3 inches).

Figure 3:
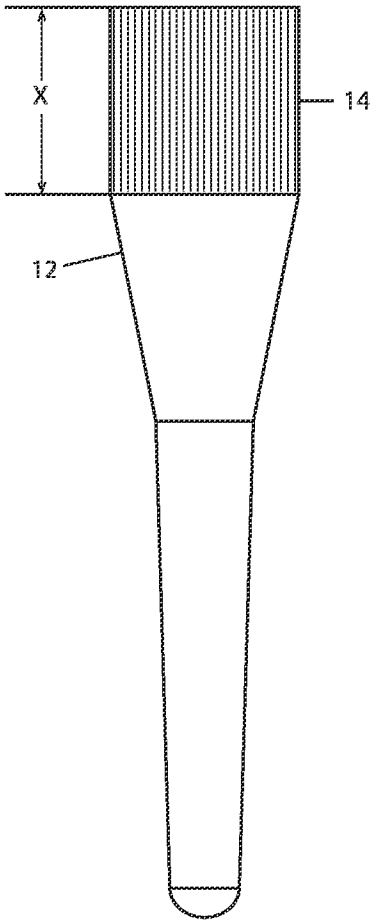
FIG. 3 diagrammatically illustrates a brush with a cylindrically shaped bristle head.

FIG. 3 diagrammatically illustrates a brush with a cylindrically shaped bristle head.

Figure 4:
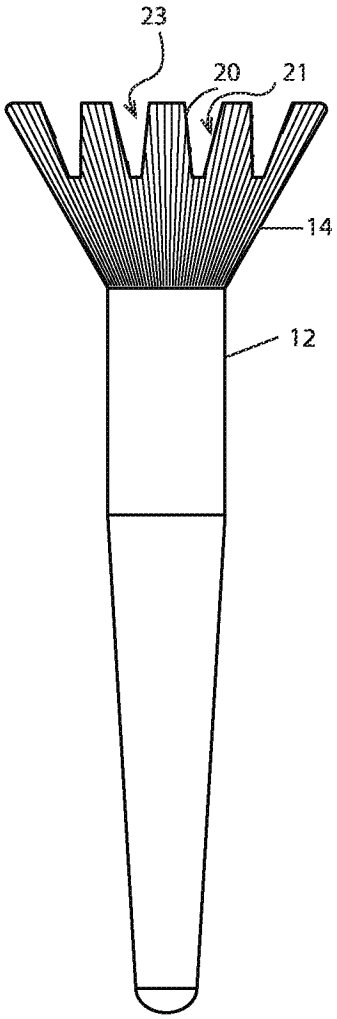
FIG. 4 diagrammatically illustrates bristle fence slats which are created by cutting away peripheral arcuate segments of the bristles.
Figure 5:
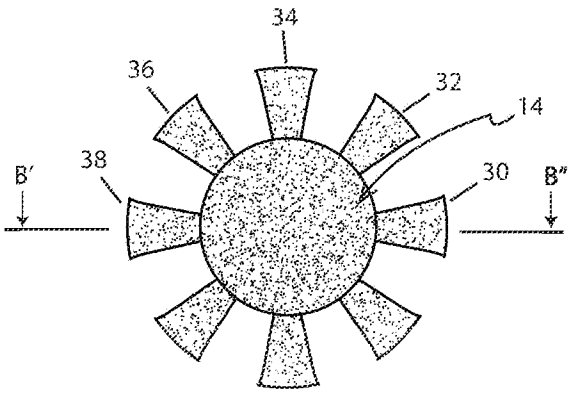
FIG. 5 diagrammatically illustrates a top view of the bristle had showing the bristle fence slats about the cut-away central void.
Figure 6:
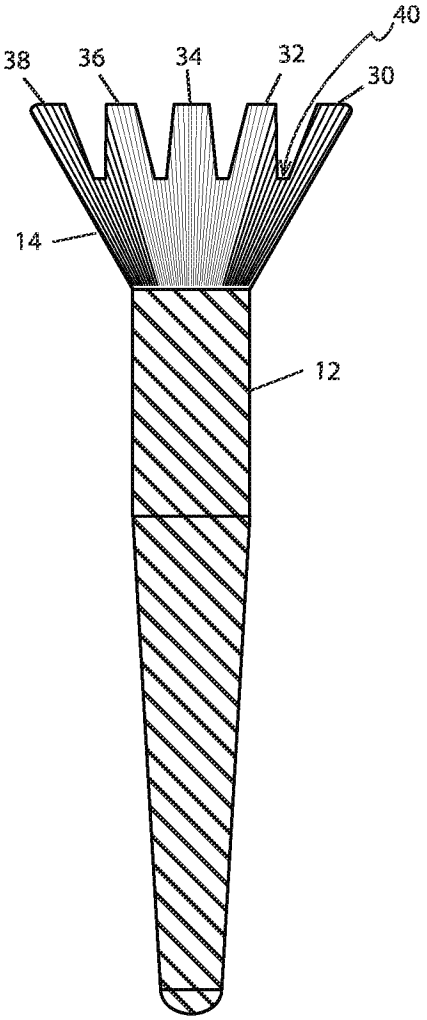
FIG. 6 diagrammatically illustrates a cross-sectional view of the bristle fence slats and the central void from the perspective of section line B'-B" in FIG. 5.

FIG. 4 diagrammatically illustrates bristle fence slats which are created by cutting away peripheral segments of the bristles. FIG. 5 diagrammatically illustrates a top view of the bristle had showing the bristle fence slats and the cut away central void. FIG. 6 diagrammatically illustrates a cross-sectional view of the bristle fence slats and the central void from the perspective of section line B'-B" in FIG. 5. FIGS. 4, 5 and 6 are discussed concurrently.

A plurality of peripheral arcuate bristle segments are cut or trimmed away from the plurality of attached bristles 14 to form no less than 4 arcuate bristle segment voids (created by cutting and trimming peripheral bristles segments) thereby forming remaining arcuate attached bristle segments 20 in FIG. 4, and 30, 32, 34, 36 and 38 in FIGS. 5 and 6. Alternatively, the brush could be manufactured with bristle fence salts. These arcuate bristle segments extend from the handle. These arcuate attached bristle segments form a bristle fence shown in FIG. 4 and shown in the cross-sectional view of FIG. 6. The fence is made of bristle fence slats bounding arcuate voids.

Figure 7:
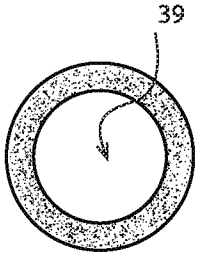
FIG. 7 diagrammatically illustrates a bristle brush head wherein the central void has been created by cutting and foreshortened a plurality of centrally extending bristles from the either conical or cylindrical bristle head. The foreshortened attached bristles should be no shorter than one-half the bristle vertical height, that is, the height of the bristle fence slats.

To form the bristle fence, a central plurality of bristles is trimmed or cut away to form a central void 39 shown in FIG. 7. The vertical span of the bristles forming the central void should be no shorter than one-half of the higher bristle vertical span of the bristle fence. This results in the remaining arcuate bristle segments forming a bristle fence about the central void. These arcuate peripheral bristle segments define spaced apart bristle fence slats about the central void of the bristle head. FIG. 7 diagrammatically illustrates a bristle brush head wherein the central void has been created by cutting and foreshortened tending a plurality of centrally extending bristles from the either conical or cylindrical bristle head. The arcuate bristle segments and spaced apart bristle fence slats are not shown in FIG. 7. The specially configured brush can be manufactured with this bristle design, using typically manufacturing techniques.

As an example, bristle fence slat 20 in FIG. 4 is spaced apart from the adjacent fence slats by voids 21, 23 which, in one embodiment of the invention, are cut away or trimming from the bristle head 14 in FIGS. 1 and 2. In another embodiment, the brush is manufactured to have a plurality of spaced apart peripheral bristle fence slats about a central bristle void. The central bristle void (see, for example, void 39*a* in FIG. 8) is defined by a plurality of foreshortened attached bristles 40 in FIGS. 6 and 8, wherein the peripheral bristle fence slats 30, 32, 34, 36, 38 define fence voids between adjacent peripheral bristle fence slats.

The central void 39, 39*a* may be created by the foreshortened bristles 40 before or after the bristle fence slats are created.

Figure 8:
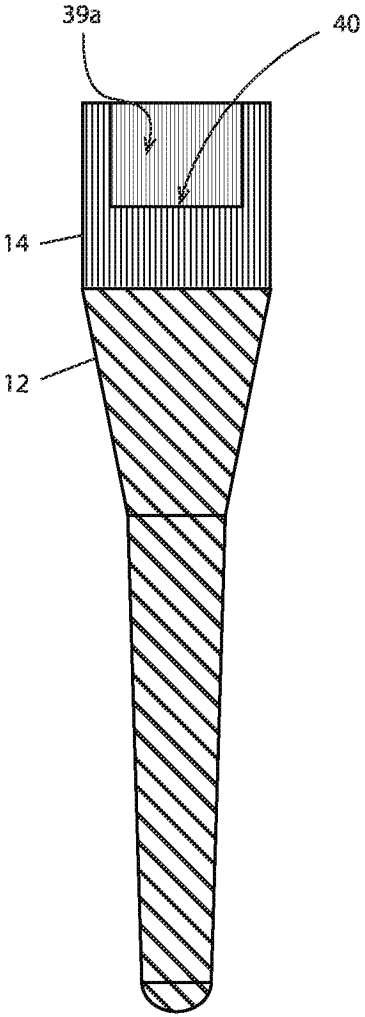
FIG. 8 diagrammatically illustrates the creation of the central void as a cross-section of the cylindrical bristle headed brush shown in FIG. 3.

FIG. 7 diagrammatically illustrates a bristle brush head wherein the central void 39 has been created by cutting and foreshortened extending a plurality of centrally extending bristles from the either conical head 14, FIG. 4, or cylindrical bristle head 14, FIGS. 3 and 8.

FIG. 8 diagrammatically illustrates the creation of the central void 39*a* as a cross-section of the cylindrical bristle headed brush 14 shown in FIG. 3.

Figure 9:
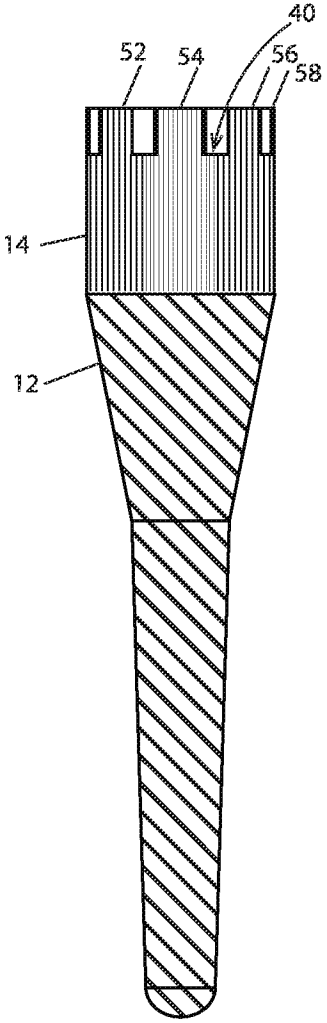
FIG. 9 diagrammatically illustrates a cross-sectional view of the cylindrical bristle heads with the bristle fence slats.

FIG. 9 diagrammatically illustrates a cross-sectional view of the cylindrical bristle head 14 with the bristle fence slats 52, 54, 56 and 58.

Figure 10:
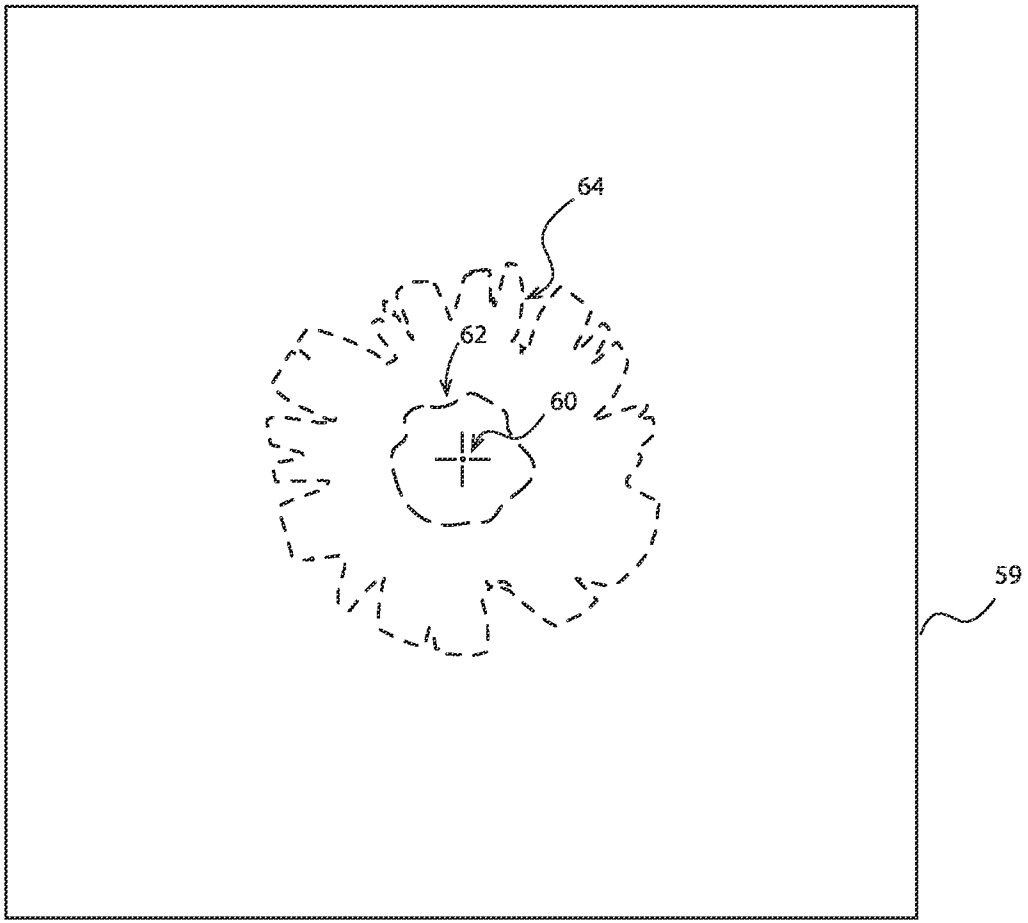
FIG. 10 diagrammatically illustrates the substrate and the nascent flower location on the substrate.
Figure 11:
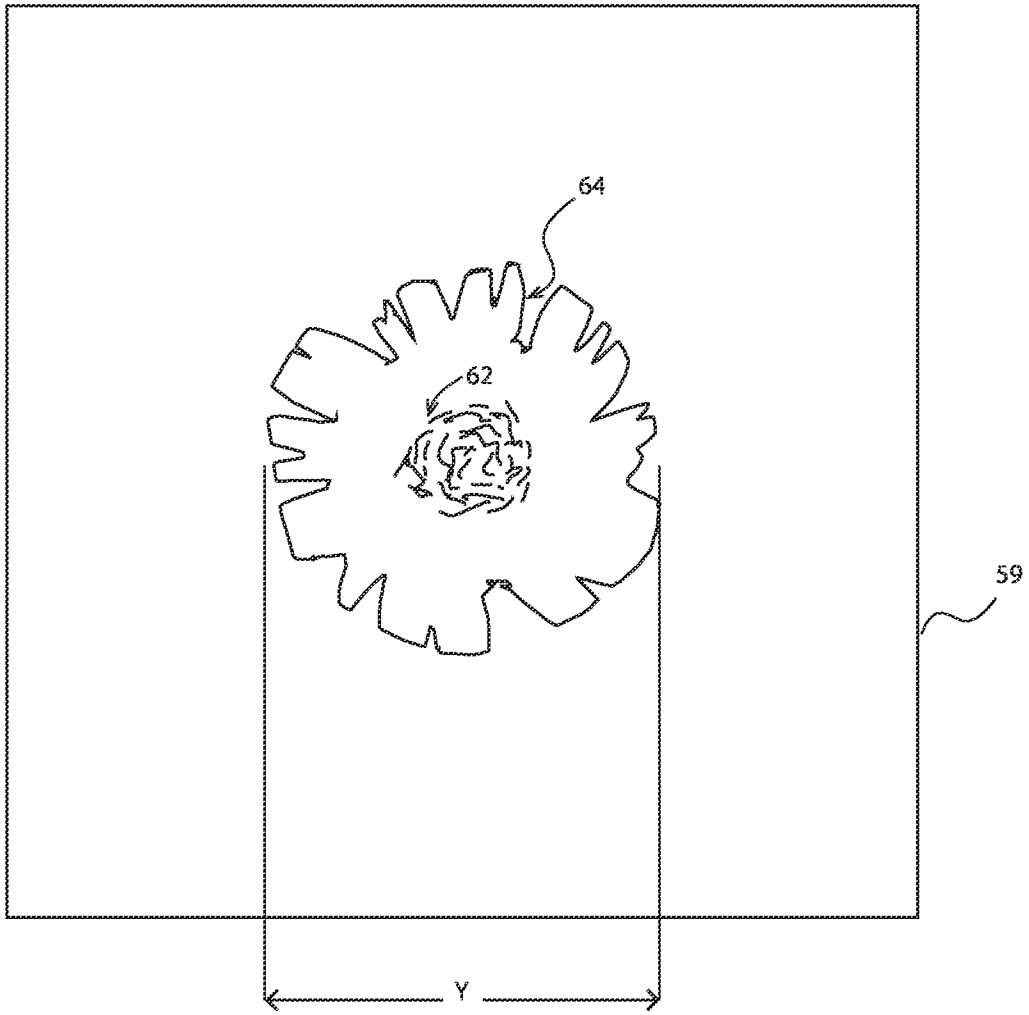
FIG. 11 diagrammatically illustrates the painted-on dollop of ovary flower color at the nascent center flower location on the substrate.

FIG. 10 diagrammatically illustrates the substrate and the nascent flower location on the substrate. FIG. 11 diagrammatically illustrates the painted-on dollop of ovary flower color at the next sent Center flower location on the substrate. FIGS. 10 and 11 are discussed concurrently.

To begin the painting process, a paintable substrate 59 is provided. The bristle fence slats, for example, slats 30, 32, 34, 36, 38 in FIG. 5, are loaded with a petal flower color to form a loaded brush. The loaded brush is placed at a nascent flower location on the substrate (the term "nascent" referring to a location where the flower is to be painted). FIG. 10 diagrammatically illustrates substrate 10 and center-point 60 is the nascent center of the painted flower. In one embodiment, the user or painter places a dollop of paint (the ovary flower color paint) on the nascent flower center 20 as shown in FIG. 11. This creates the ovary flower center. In FIG. 10, dashed line 62 shows the to-be-painted flower.

The paint loaded brush is pressed gently on the substrate 59 thereby spreading the bristle fence slats radially outward. In FIG. 10, the random, radial extension of the to-be painted flower is shown in dash-dot-dash lines 64. In FIG. 11, the painted on petals (using the petal paint color pre-loaded on bristle fence slats) extends generally radially and randomly outward from ovary center 62 a distance Y. The outer periphery of the flower is randomly variable due to the artist's hand motion and the bending of the paint-loaded bristle fence slats. Of course, when the paint-loaded bristle fence slats strike the substrate, paint is deposited on the substrate. Also, the radial spread of the bristle fence slats is random and the arcuate spread between the pushed out fence slats is also random. The loaded brush is then lifted off the substrate.

Often times, prior to placing the paint-loaded fence slats on the nascent flower location, a dollop of ovary flower color is placed on the nascent flower center location 60 on the substrate 59 to form an ovary flower center 62 (FIG. 11). Thereafter, the loaded brush is gently pressed at the nascent flower center location on the substrate. The paint carrying fence slats spread out from the painted on ovary flower color. The central void 39*a*, FIG. 8, typically does not carry paint. In this manner, the petal color is generally separated from the pre-painted ovary center color. In this painting procedure, placing the loaded brush at the nascent flower location includes placing the loaded brush and the loaded bristle fence slats about the ovary flower center previously painted on the substrate.

Of course, the painter may choose to place the paint carrying bristle fence slats on the substrate first, then apply the central ovary flower color on the substrate.

The claims appended hereto are meant to cover modifications and changes within the scope and spirit of the present invention.

What is claimed is:

1. A method of painting flowers with a makeup brush comprising:

providing a makeup application brush having a handle and a plurality of attached bristles extending no more than 3 inches wherein the attached bristles extend from the handle as a solid conical shape or a solid cylindrical shape wherein the conical outboard radius does not exceed twice the attached bristle extension of no more than 3 inches;

trimming a plurality of peripheral arcuate bristle segments from the plurality of attached bristles forming no less than four arcuate bristle segment voids in the plurality of attached bristles thereby forming remaining arcuate attached bristle segments extending from the handle; trimming a central plurality of bristles from the plurality of attached bristles forming a central void in the plurality of attached bristles;

whereby the remaining arcuate attached bristle segments form a bristle fence about the central void defining spaced apart bristle fence slats;

loading the bristle fence slats with a petal flower color to form a loaded brush;

providing a paintable substrate;

placing the loaded brush at a nascent flower location on the substrate and pressing the loaded brush on the substrate thereby spreading the bristle fence slats radially outward; and lifting the loaded brush off the substrate.

2. The method of painting flowers with the makeup brush as claimed in claim 1 wherein the paintable substrate is a canvas or a paintable paper and pressing the loaded brush on the canvas or the paintable paper.

3. The method of painting flowers with the makeup brush as claimed in claim 1 including placing a dollop of ovary flower color at the nascent center flower location on the substrate thereby forming an ovary flower center before placing the loaded brush at the nascent flower location on the substrate.

4. The method of painting flowers with the makeup brush as claimed in claim 3 wherein the step of placing the loaded brush at the nascent flower location includes placing the loaded brush and the loaded bristle fence slats about the ovary flower center on the substrate.

5. A method of painting flowers with a brush comprising:

providing a brush having a handle and a plurality of attached bristles extending no more than 2 inches from the handle in either a cylindrical or a conical manner, wherein the plurality of attached bristles form a plurality of spaced apart peripheral bristle fence slats about a central bristle void, the central bristle void defined by a plurality of foreshortened attached bristles, wherein the peripheral bristle fence slats define fence voids between adjacent peripheral bristle fence slats;

loading the bristle fence slats with a petal flower color to form a loaded brush;

providing a paintable substrate;

placing the loaded brush at a nascent flower location on the substrate and pressing the loaded brush on the substrate thereby spreading the bristle fence slats radially outward; and lifting the loaded brush off the substrate.

6. The method of painting flowers with the brush as claimed in claim 5 wherein the paintable substrate is a canvas or a paintable paper and pressing the loaded brush on the canvas or the paintable paper.

7. The method of painting flowers with the brush as claimed in claim 5 including placing a dollop of ovary flower color at the nascent center flower location on the substrate thereby forming an ovary flower center before placing the loaded brush at the nascent flower location on the substrate.

8. The method of painting flowers with the brush as claimed in claim 7 wherein the step of placing the loaded brush at the nascent flower location includes placing the loaded brush and the loaded bristle fence slats about the ovary flower center on the substrate.

* * * * *